US007423551B1

(12) United States Patent
Sharrow

(10) Patent No.: US 7,423,551 B1
(45) Date of Patent: Sep. 9, 2008

(54) METHOD AND APPARATUS FOR CONTROLLING TEMPORARY TRAFFIC SIGNALS

(76) Inventor: John A. Sharrow, 160 Pelican Dr. NE., Palm Bay, FL (US) 32907

( * ) Notice: Subject to any disclaimer, the term of this patent is extended or adjusted under 35 U.S.C. 154(b) by 281 days.

(21) Appl. No.: 11/464,525

(22) Filed: Aug. 15, 2006

(51) Int. Cl.
*G08G 1/095* (2006.01)

(52) U.S. Cl. ..... 340/908; 340/907; 116/63 R; 40/446; 40/611.13; 40/607.01

(58) Field of Classification Search ..... 340/907, 340/908; 40/446–537, 607.01–611.13; 116/63 R, 116/63 P
See application file for complete search history.

(56) References Cited

U.S. PATENT DOCUMENTS 3,863,214 A * 1/1975 Kerr, Jr. ..... 340/932.1
5,252,696 A * 10/1993 Laas et al. ..... 528/49
5,504,481 A * 4/1996 Wys ..... 340/931
5,695,305 A 12/1997 Heym
5,805,081 A * 9/1998 Fikacek ..... 340/908
6,034,609 A * 3/2000 Comiskey, Jr. ..... 340/631
6,118,388 A * 9/2000 Morrison ..... 340/908
6,392,563 B1 5/2002 Paquette et al.
6,847,306 B2 * 1/2005 Diba et al. ..... 340/906
7,193,529 B1 * 3/2007 Shah ..... 340/907

* cited by examiner

*Primary Examiner*—Jeff Hofsass
*Assistant Examiner*—Edny Labbees
(74) *Attorney, Agent, or Firm*—Kenneth L. Nash

(57) ABSTRACT

A temporary or portable traffic signal can be utilized to regulate traffic during power outages. However, when power is restored and the normal operation of the permanently installed traffic signal resumes, then a method of interconnecting the permanent and temporary systems ensures that the operation of the two system are synchronized in predetermined and/or selectable modes of operation. Whenever power is available, an interface detects operation of the permanently installed main system and produces signals that can be used in one mode of operation to direct the portable system to ignore its internal timing sequences and synchronize with the main system, or in another mode of operation to cease its operation.

19 Claims, 6 Drawing Sheets

METHOD AND APPARATUS FOR CONTROLLING TEMPORARY TRAFFIC SIGNALS

FIELD OF THE INVENTION

The present invention relates generally to the field of traffic control devices, and particularly to traffic signals intended for portable or temporary use.

BACKGROUND OF THE INVENTION

Traffic signals are installed at more than 312,500 intersections in the U.S. These signals are operated by connection to utility power lines. In the event of a power interruption, these signals become inoperative, creating a hazardous situation for vehicle operators and passengers. To alleviate this situation, an increasing number of major intersections have been equipped with backup power systems, typically capable of powering the signals for a few hours, while power is being restored, or temporary stop signs are erected.

A number of portable traffic signals have been designed, which might have use in such situations. However, a significant safety issue hampers their use. When power is restored to the system, timing of the temporary, portable devices does not match that of the permanently mounted signals. Even small differences in timing, over a period of minutes or hours, can result in conflicts where, for example, the permanent signal may be red in a given direction, while the portable signal shows green. It is easy to imagine the confusion this could cause, and the resulting accidents. Given the typical disruption that results when the power goes out, it could be hours or even days before a crew arrives to remove the portable signal.

The present invention describes a control system that resolves this conflict. During a power outage, a temporary traffic signal can function in response to timing commands from its own controller, maintaining order. However, when power is restored, the temporary signal timing is determined by data inputs from the permanently installed signal, with the result that both display identical indications, and change at the same time. As an option, if conditions warrant, data inputs from the permanently installed signal can be used to inhibit operation of the temporary signal.

Those of skill in the art will appreciate the present invention, which addresses the above problems and other significant problems, the solutions to which are discussed hereinafter.

SUMMARY OF THE INVENTION

An object of the present invention is to provide an improved temporary traffic control system.

Another objective of the present invention is to provide a temporary traffic control signal system that may be synchronized in a programmable way or selectable way with a permanent traffic control signal that may be present at the same location.

The present invention relates generally to traffic control signals, and particularly to the use of temporary or portable devices that are intended to be employed during power outages. The temporary signal can be linked to the permanent signal, so that when power is restored, the controller for the permanent signal directs the timing for both, causing them to operate in synchronization. Alternatively, when power is restored, a link from the permanent signal controller may be used to tell the controller for the temporary signal to shut down operation of the temporary traffic signal.

Accordingly, the present invention provides a portable traffic signal system that is operable for use at the same location as a permanent traffic signal system without interference therebetween. The permanent traffic signal system may comprise permanently mounted electrically operated signals for controlling traffic flow direction and a permanently mounted system controller, which generates a predetermined sequence of operation. The present invention may be especially useful when the permanent traffic signal system is subject to outages such as those caused by temporary weather conditions. In one embodiment of the invention, the portable traffic signal system may comprise elements such as portable electrically operated signals to be displayed for controlling the traffic. A portable power supply may be used to operate the portable electrically operated signals. A portable system controller may be used that is operable for controlling the electrically operated signals to be displayed. For example, the portable power supply might comprise a battery and/or a solar panel and/or a generator. The system may further comprise one or more timing mechanisms for generating a predetermined timing sequence to control a sequence of operation of the portable electrically operated signals to be displayed. An interface may be provided for sensing operation and outage of the permanently mounted electrically operated signals and for producing external control data in response to the operation and/or outage of the permanently mounted electrically operated signals. The invention may further comprise a receiver for receiving external control data either wirelessly or hardwired.

When the external control data is present, then the portable system controller may be configured to respond to receipt of the external control data in at least one of a first mode of operation or a second mode of operation. In the first mode of operation, the portable electrically operated signals may be partially or fully inhibited. In the second mode of operation, operation of the portable electrically operated signals may be synchronized with the permanently mounted electrically operated signals to avoid conflicting signals being given by the two systems.

When the external control data is absent, such as might occur if a power outage arises, then the portable system controller is configured to utilize the predetermined timing sequence generated by the timing mechanisms for controlling the portable electrically operated signals.

The system may further comprise a wireless link between the interface and the portable traffic signal system and/or the permanent traffic signal system. In one embodiment, the system may further comprise one or more optical sensors for detecting operation of the permanent traffic signal system.

The portable system controller may be configured to override at least partially the predetermined timing sequence by responding to external instruction signals wherein the external instruction signals are utilized to determine a function, timing, or other characteristics of the sequence of operation of the portable electrically operated signals.

In another embodiment of the invention, a portable system may comprise electrically operated signals to be displayed for controlling the traffic, a plurality of switches to operate the electrically operated signals, a portable system controller operable for controlling the plurality of switches, and one or more timing mechanisms for generating a predetermined timing sequence for use by the portable system controller to control a sequence of operation of the electrically operated signals to be displayed.

In one embodiment, when the external control data is absent then the portable system controller is operable to override at least partially the predetermined timing sequence by responding to external sensors that indicate the presence and/or location of vehicles and the predetermined timing sequence. In another embodiment, the portable system controller is operable to override at least partially the predetermined timing sequence by responding to external pre-emptive signals that indicate the approach of one or more emergency vehicles, in which case the portable system controller may respond according to a predetermined instruction set. In another embodiment, then the portable system controller is operable to override at least partially the predetermined timing sequence by responding to external instruction signals, which determine the function, timing, or other characteristics of the portable system controller.

The present invention provides methods to provide backup traffic signals for controlling traffic that are suitable for temporarily replacing a permanent traffic signal system. In one embodiment, the method may comprise steps such as, for example only, providing portable electrically operated traffic signals suitable to be displayed at a selectable location for controlling the traffic and/or generating a predetermined timing sequence to control a sequence of operation of the portable electrically operated traffic signals. Other steps may comprise providing a receiver for receiving external control data when the external control data is available. The method may further comprise controlling the portable electrically operated signals utilizing the predetermined timing sequence when the external control data is not available and controlling the portable electrically operating signals responsive to receipt of the external control data when the external control data exists for coordinating operation of portable electrically operated signals in a predetermined manner.

In one possible embodiment, the step of controlling the portable electrically operating signals responsive to receipt of the external control data when the external control data exists might comprise operation in at least one of a first mode of operation or a second mode of operation. In the first mode of operation then the permanent traffic signal systems are utilized substantially exclusively for controlling a direction of flow of the traffic. In the second mode of operation, then the external control data controls are utilized to provide synchronization between the portable electrically operating signals and the permanent traffic signal system.

The method may further comprise providing a selector for selecting between the first mode of operation and the second mode of operation. The step of receiving might further comprise receiving the external control data from the permanent traffic signal system whenever the permanent traffic signal system is operational. In one embodiment, intermittent operation of the permanent traffic signal system may result in a synchronization of the portable electrically operating signals with signals of the permanent traffic signal system whenever the permanent traffic signal system is in operation. Thus, the system will repeatedly synchronize to external data in a predetermined way as needed to permit both systems to work together. The external control data may or may not be wirelessly transmitted. Optical sensors may or may not be used to detect operation of the permanent traffic signal system.

BRIEF DESCRIPTION OF THE DRAWINGS

For a further understanding of the nature and objects of the present invention, reference should be had to the following detailed description, taken in conjunction with the accompanying drawings, in which like elements may be given the same or analogous reference numbers.

While the present invention will be described in connection with presently preferred embodiments, it will be understood that it is not intended to limit the invention to those embodiments. On the contrary, it is intended to cover all alternatives, modifications, and equivalents included within the spirit of the invention.

DETAILED DESCRIPTION OF THE INVENTION

Figure 1:
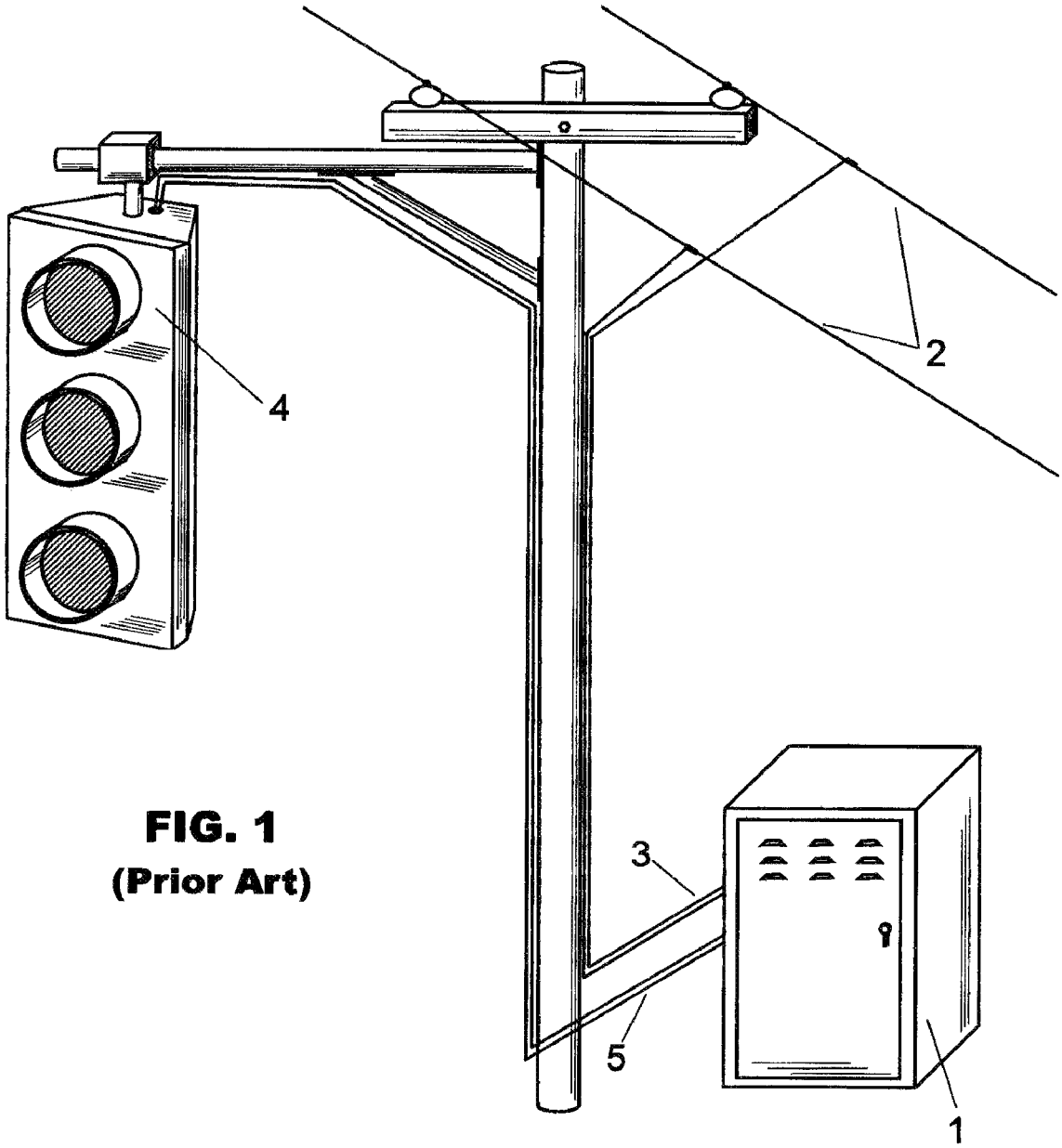
FIG. 1 (Prior Art)
FIG. 1 shows a typical permanently installed traffic signal head, with controller and power connection.

Now referring to the drawings, and more particularly to FIG. 1, there is shown a typical permanently installed traffic signal that utilizes one or more signal heads 4, connected via a cable 5 to a controller 1. Controller 1 is normally connected by a cable 3 to ac utility lines 2. By permanently-installed it is meant a system that is intended to be continuing or enduring (as in the same state, status, place) without fundamental or marked change for the reasonably foreseeable future and not subject to fluctuation or alteration due to anticipated hazards or outages such as hurricanes, snow storms, or other temporary conditions.

Figure 2:
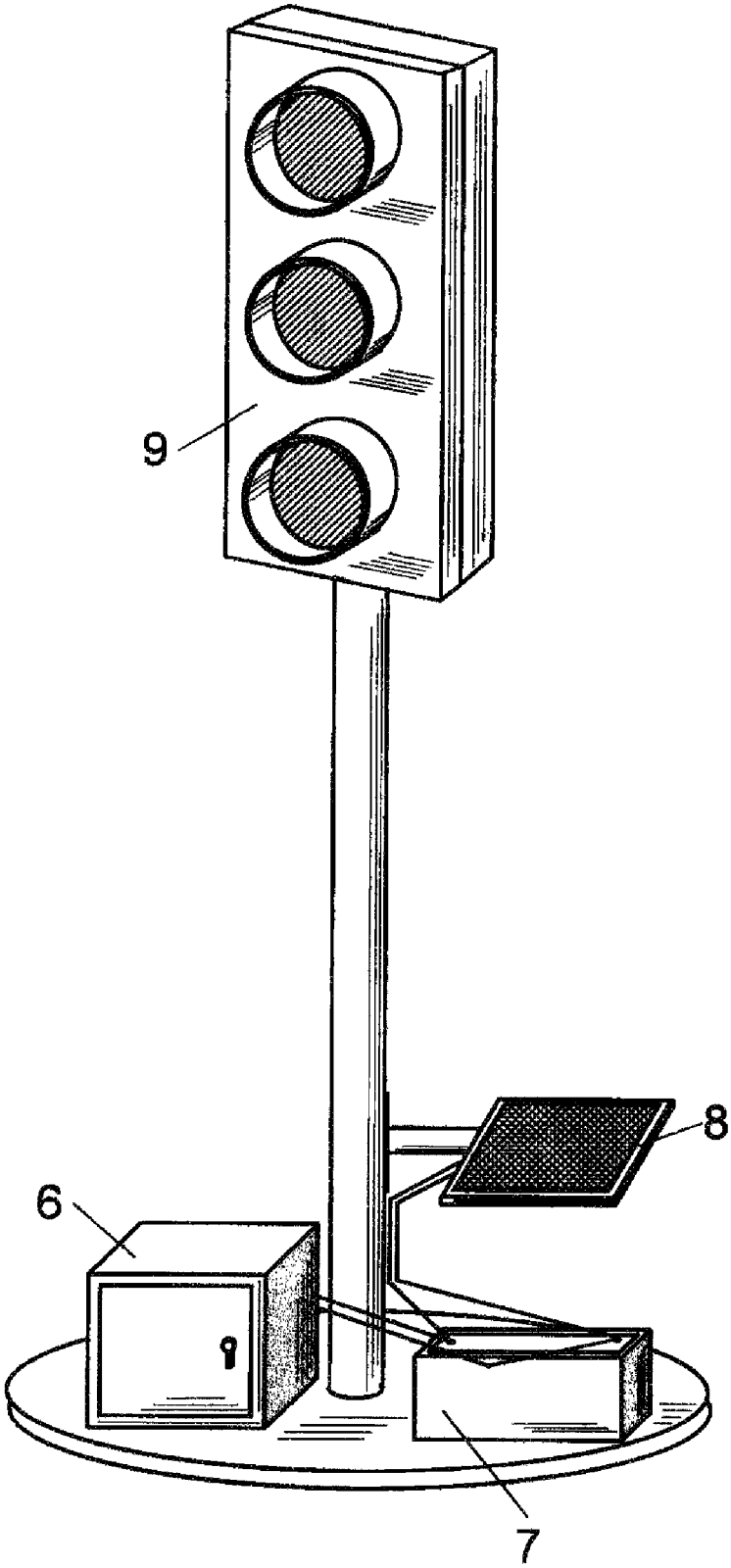
FIG. 2 (Prior Art)
FIG. 2 depicts a typical temporary or portable traffic signal, with its controller, battery, and a solar charger.

In FIG. 2, a typical prior art portable traffic signal is shown that consists of one or more signal heads 9, wired to a control unit, 6. Power is typically supplied by a battery pack 7, which may be recharged by a solar panel 8. A temporary system is intended to be lasting for a time only, e.g. existing or continuing for a limited time and is not intended to replace the permanent system except temporarily. For instance, the permanent system will normally remain in place if the temporary system is used in the same location.

Figure 3:
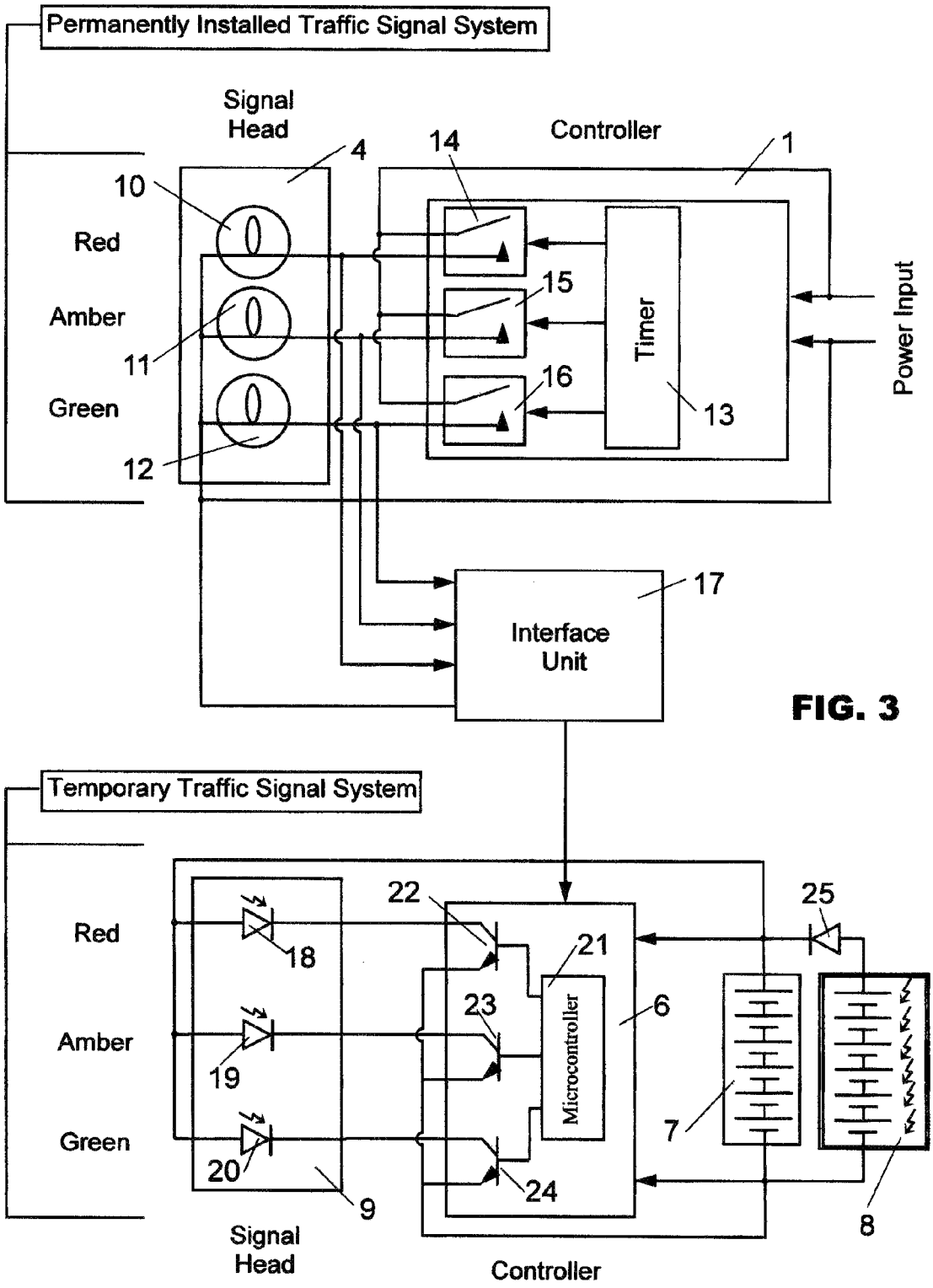
FIG. 3 is a schematic diagram of a temporary or portable signal interconnected with a permanently installed traffic signal, through a hard-wired interface unit, in accordance with this invention.

FIG. 3 shows one possible embodiment of the present invention wherein operation of a temporary traffic signal system is coordinated with that of a permanently installed traffic signal system. In this embodiment, controller 1 of the permanently installed traffic controller system comprises timer 13 and switching devices 14, 15, and 16. Timing sequences generated by timer 13 are used to control switching devices 14, 15, and 16, which may comprise electrically controlled switching devices such as relays or the like. When each of switching devices 14, 15, and 16 is energized, power is supplied to the respective lamp or LED array 10, 11, or 12. This results in illumination of the selected color lens of traffic signal head 4.

In accord with one embodiment of the present invention, a temporary traffic light system may be brought in for temporary use at the same location as the permanently installed traffic system, e.g., in the days immediately before a hurricane is approaching when it is highly possible that power to the permanent traffic light system may be disrupted. In accord with the present invention, traffic jams and/or accidents may be avoided at times when it is highly desirable to avoid traffic jams, thereby saving lives and money.

The temporary system may or may not initially operate simultaneously with the permanently installed traffic system. The temporary system may sleep until it is needed and/or may shut off after it is not needed. If it does operate at the same time as the permanent system, then it operates in synchronization with the permanent system. If the permanent system is initially off, or if it ceases to operate and subsequently returns to functioning, then the temporary system may or may not switch off after the permanent system resumes operation, at some unknown time, e.g., when power is restored.

In this embodiment, temporary controller 6 generates timing sequences according to predetermined instructions, which may comprise programming for microcontroller 21. Besides microcontroller 21, other types of timing control signals or mechanism may also be utilized to perform the functions of controller 6. In this example, microcontroller 21 provides appropriate control signals to switching devices 22, 23, and 24, which may comprise transistors, relays, or other switching devices. Switching devices 22, 23, 24 apply power to LED or other signaling devices 18, 19, and 20. Signaling devices 18, 19, and 20 may mounted behind red, amber, and green lens, respectively, of the temporary traffic signal head 9, causing it to display the selected color. Following in sequence, temporary controller 6 provides signals at the proper times to switching devices 22, 23 and 24, applying power to signaling devices 18, 19 and 20 at the proper times, selectively displaying the red, amber and green signals of temporary traffic signal head 9.

In this embodiment, interface unit 17 is utilized to provide synchronization information from the permanently installed traffic light system, when the permanently installed traffic light system is working. Permanently installed traffic signal controller 1 may be connected to interface unit 17, as shown in FIG. 3. Operation might be controlled from power sensed at the signal lamps 10, 11, and 12, and/or when power is sensed at the output of switching devices 14, 15, and 16. For example, whenever power is applied to lamps 10, 11, or 12, interface unit 17 may generate a data output to a signal connection, which may be of various types, to controller 6, as indicated in FIG. 3, informing temporary controller 6 of the condition. When the signals are received from interface unit 17, temporary controller 6 responds in accordance with preset instructions for microcontroller 21, disregarding its internally generating timing sequences, and synchronizing the signals to switching devices 22, 23, and 24 to correspond to the respective output of permanently-installed controller 1. Thus, the signal indications of temporary signal head 9 are made to correspond to those of permanently installed signal head 4. Operation of the respective lamps 10, 11, and 12 might be sensed by reading the voltage or current applied, or the power consumed by each lamp.

For some types of temporary traffic signals and in certain operating conditions, it may be preferable to render the temporary traffic signal inoperative when the permanently installed traffic signal resumes operation. In such cases, temporary controller 6 may be programmed to respond by inhibiting operation of temporary signal head 9, as an alternate means of preventing conflicts with the permanently installed system. In this case, a simplified interface unit may be employed, which simply indicates the presence of ac power to permanently installed controller 1.

Figure 4:
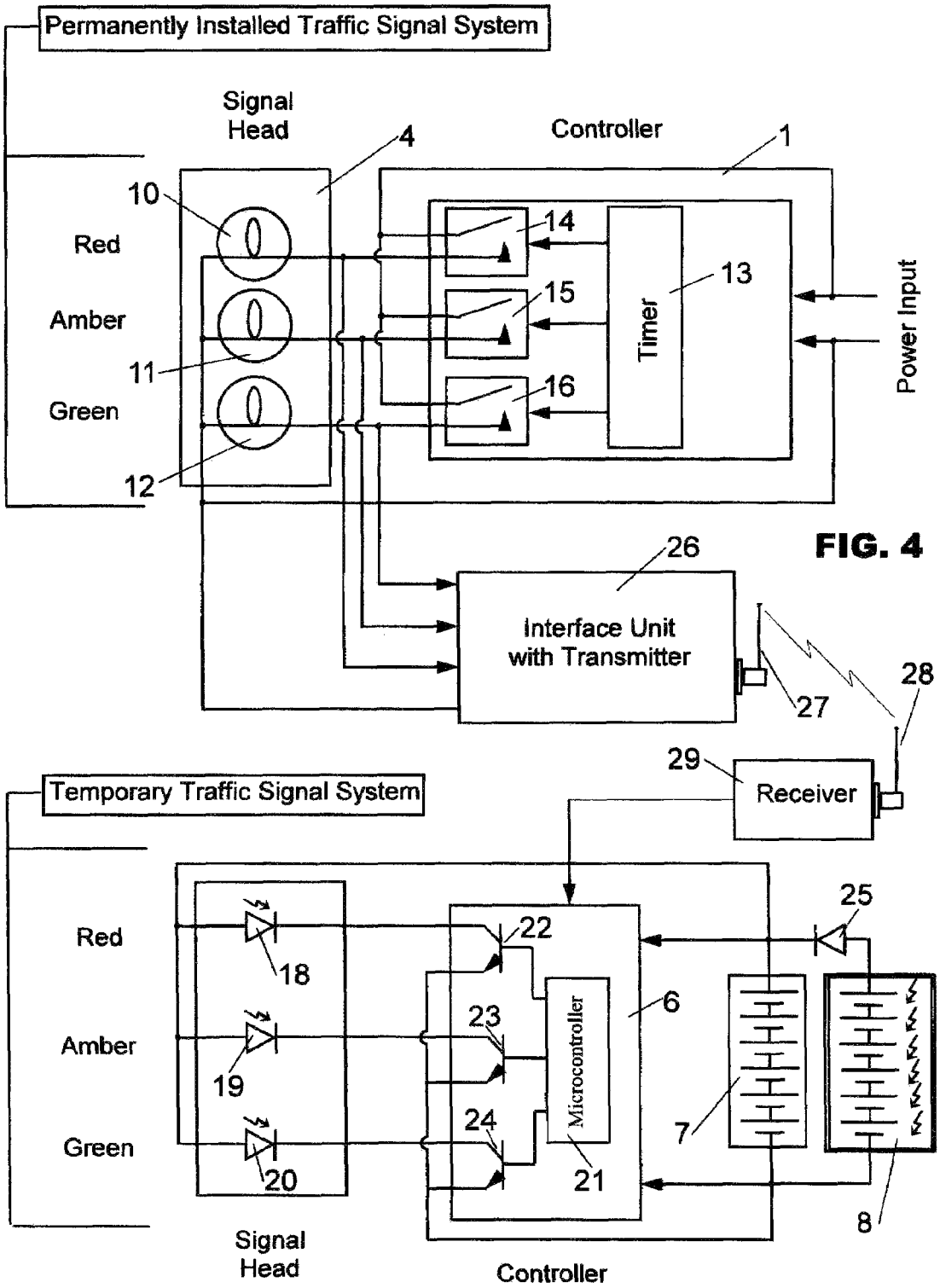
FIG. 4 is a modified version of FIG. 3 in which the interface unit is hard-wired to the permanently mounted system, and communicates wirelessly with the temporary or portable system controller.

In order to simplify and expedite setup of the temporary or portable traffic signal, a preferred embodiment is shown in FIG. 4, in which a wireless connection is utilized to interconnect the permanently installed controller 1 with temporary signal controller 6. Operating in the same manner as previously described, an interface unit with a transmitter 26 and antenna 27 is connected to the outputs of permanently installed controller 1. Data is then provided to temporary controller 6 via antenna 28 and receiver 29. The wireless link may utilize radio frequency signals as depicted in FIG. 4, or alternatively employ an infrared, ultrasonic, or other interconnection medium.

While a hardwired connection is shown for interconnection of interface 17 and interface 26 to controller 1, a wireless connection may also be utilized. Moreover, interface 17 and interface 26 may be provided separately from controllers 1 and 6, and/or may be provided within either one, and/or may be provided within both and may coordinate with each other. Portions of interfaces 17 and/or 26 may or may not reside in either the permanently installed traffic signal system and/or the temporary traffic signal system. Interface units 17 and/or 26 may also comprise various types of connections to other control circuits and/or networks and/or wireless and/or telephone and/or computer linkages as desired for additional and/or remote control when available.

Figure 5:
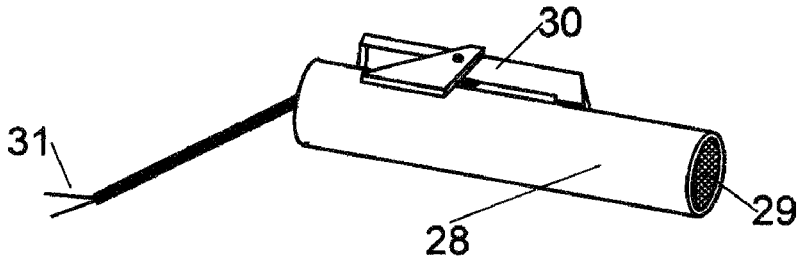
FIG. 5 depicts a clip-on sensor, which can be used as an alternative method of connecting the interface unit to the permanently installed system.
Figure 6:
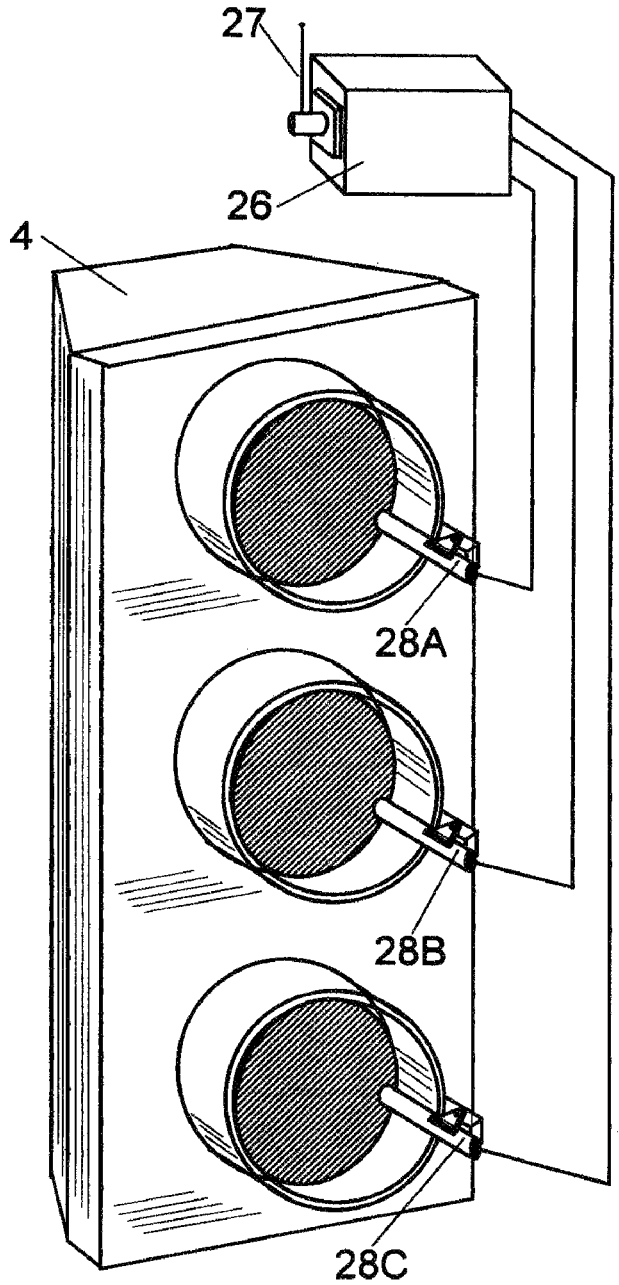
FIG. 6 is a view of a permanently installed signal head, with clip-on sensors attached.

FIG. 5 depicts an alternative method of sensing the data required for operation of the interface unit wherein an electrical connection to the wiring or radio link or the like to the permanently installed traffic signal system is not necessary. In this embodiment, a sensor body 28 as shown in FIG. 5 may be fitted with a light sensor 29. A spring-loaded mounting clip 30, clamp, bolt, or the like, may be utilized for to sensor body 28. In this way, sensor bodies 28A, 28B, and 28C may be connected to the respective light head 4 of the permanent traffic system to reliably sense operation thereof and/or to sense when the permanent traffic light system is not working. Signals from light sensor 29 are routed to the respective interface unit via cable 31 and/or wirelessly and/or by any other suitable means. Therefore, in the embodiment shown in FIG. 6, instead of a hard-wired or wireless connection to the permanently installed controller 1, as shown in FIGS. 4 and 5, clip-on sensors 28A, 28B, and 28C, are attached to the permanently installed signal head, responding to illumination of the respective lenses, and providing data to the interface unit.

Figure 7:
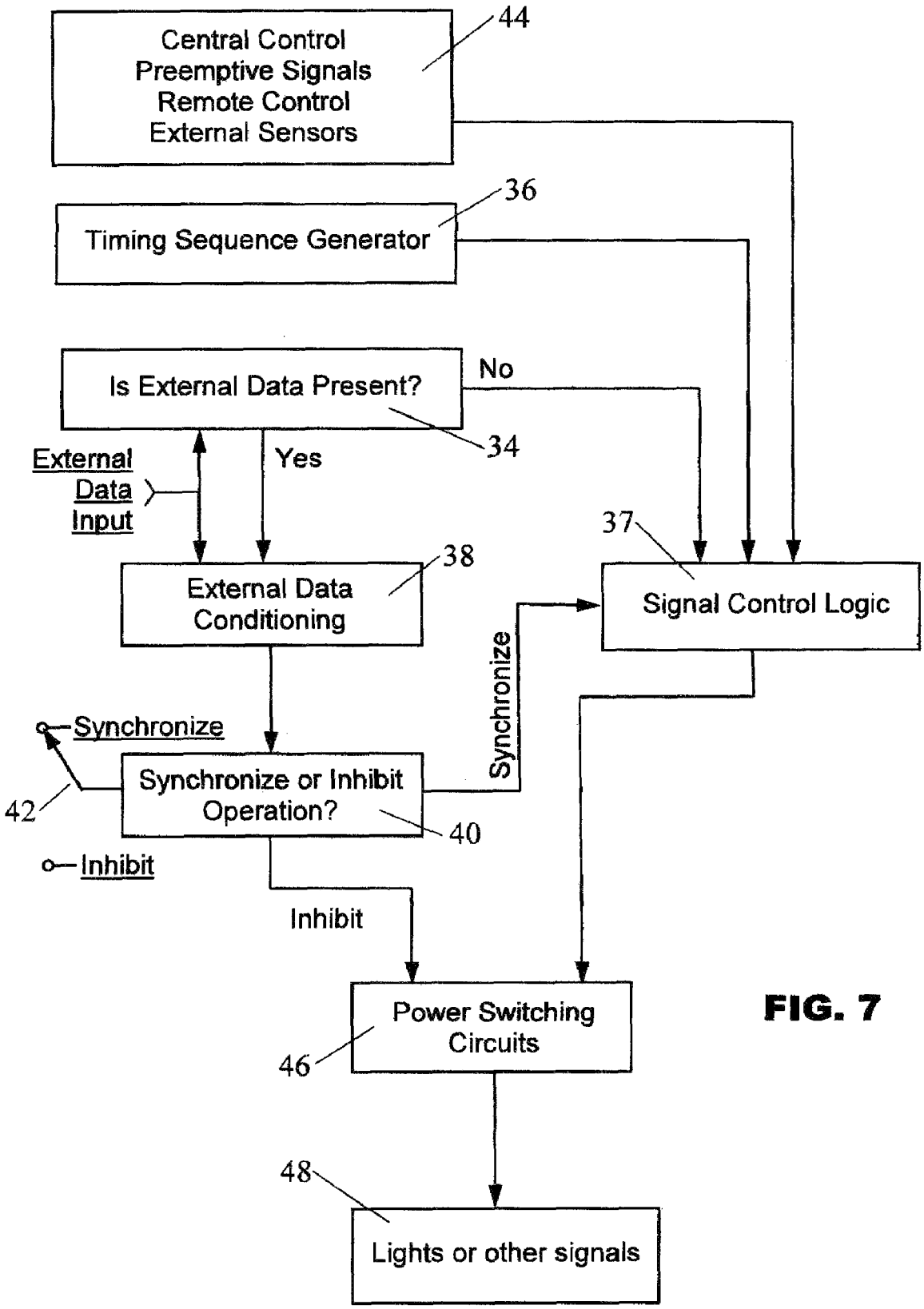
FIG. 7 is a chart showing the decision process by which external data takes command of the temporary traffic signal controller either by synchronizing it with the controller of the permanently installed traffic signal, or by inhibiting operation of the temporary traffic signal, depending upon the mode selected.

One possible example of programming instructions utilized for operation of controller 6 in accord with the present invention is provided in FIG. 7. As indicated at 34, the programming/sensing determines, whether external data, such as data originating from controller 1 is present. As previously described, the presence of external data from a permanently installed controller tells the temporary controller to ignore its internally generated timing sequences that may be produced by timing sequence generator 36. Depending on the type of external data, e.g., wireless, wired, and how it is produced, signal conditioning for use with the temporary signal system may be required as indicated at 38. Depending on the mode selected, the temporary controller may selectively synchronize its operation with the external data so that the permanent and the temporary traffic signal systems provide the same signals to direct traffic. Alternatively, the temporary controller may inhibit operation of the temporary traffic signal as indicated at 40. When inhibited, temporary traffic signal lights or other traffic signals 48 may be completely turned off to allow exclusive use of the permanent traffic signal system or may have one or more lights placed in a flashing mode or warning mode that may operate in this reduced functioning mode with the permanent traffic signal system. This selection may be accomplished by a switch, jumper, or remote control, or may be made in software, permanently or conditionally, as indicated at 42. As indicated at 44, a local or distantly located remote control, or additional interface from a network, radio link, emergency vehicle or other preemptive signals, external traffic sensors to detect the presence of vehicles, or the like, may be employed to manually and/or automatically select and/or alter or change the timing, function, or other characteristics of said portable system controller and/or other functions of controller 6.

As discussed previously, power-switching circuits 46, such as relays 14, 15, and 16, or solid-state switches as indicated at 22, 23, and 24, may be inhibited from operation or controlled by signal control logic 37. As discussed above, power-switching circuits 46 are utilized to activate the traffic lights or other signals as indicated at 48.

As discussed briefly above, the interface unit may be a separate, self-contained unit, or can be incorporated into the existing hardware and/or software of the permanently installed controller, the temporary traffic signal controller, or portions of each. Separate interface units, or portions thereof; may be incorporated into both systems. Moreover, while the interface unit is shown as synchronizing operation of the temporary system by signals from the permanent system, the reverse may also be true. Thus, the permanent traffic signal system could be synchronized to the temporary traffic signal system if desired. Moreover, the permanent traffic signal system may be controlled to prevent operation thereof while the temporary traffic signal system is operating.

Alternatively, the interface may be utilized for controlling both the permanent traffic system and the temporary traffic system and/or controlling either selectively. Moreover, the interface system may connect to other controlling systems such as a central control system, radio links, and the like, which may be utilized to originate traffic control systems and/or change the signals or synchronize the signals so as to coordinate traffic signals throughout a region, as desired.

As with the interface unit, the controller may be implemented in many different ways, may be incorporated completely or partially within the temporary traffic signal system, and may possibly be at least partially externally and/or remotely implemented and/or incorporated as part of the interface.

Therefore, the foregoing description is intended as an example of a typical use of the invention, to promote understanding, and is not meant to restrict the many variations of the principles employed, which will be understood by those skilled in the art. It will be appreciated by those skilled in the art that various changes may be made in the design, organization, order of operation, means of operation, equipment structures and location, methodology, the use of mechanical/electrical/wireless equivalents, such as different types of connectors/transmissions/radio links/signals carried by power lines/and the like. Thus, rather than the illustrated embodiments, other embodiments may be utilized whereby different sequences of steps may are utilized and/or details of the illustrated construction or combinations of features of the various elements may be made without departing from the spirit of the invention. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. As well, the relative size and arrangement of the components may be varied from that shown and the invention still operate well within the spirit of the invention as described hereinbefore and in the appended claims.

What is claimed is:

1. A portable traffic signal system operable for use at the same location as a permanent traffic signal system, said permanent traffic signal system comprising permanently mounted electrically operated signals for controlling traffic and a permanently mounted system controller which generates a predetermined sequence of operation for said permanently mounted electrically operated signals, said permanent traffic signal system being subject to outages, said portable traffic signal system comprising:

portable electrically operated signals to be displayed for controlling said traffic, said portable electrically operated signals being configured for use at a selectable location;

a portable power supply to operate said portable electrically operated signals;

a portable system controller operable for controlling said electrically operated signals to be displayed;

one or more timing mechanisms for generating a predetermined timing sequence to control a sequence of operation of said portable electrically operated signals to be displayed;

an interface for sensing operation and outage of said permanently mounted electrically operated signals and for producing external control data in response to said operation or outage of said permanently mounted electrically operated signals; and a receiver for receiving external control data, when said external control data is present then said portable system controller being configured to respond to receipt of said external control data in at least one of a first mode of operation wherein operation of said portable electrically operated signals is at least partially inhibited and a second mode of operation wherein operation of said portable electrically operated signals is synchronized with said permanently mounted electrically operated signals, and wherein when said external control data is absent then said portable system controller is configured to utilize said predetermined timing sequence generated by said one or more timing mechanisms for controlling said portable electrically operated signals.

2. The system of claim 1 further comprising a wireless link between said interface and at least one of said portable traffic signal system and said permanent traffic signal system.

3. The system of claim 2 wherein said interface further comprises a wireless transmitter.

4. The system of claim 1 further comprising one or more optical sensors for detecting operation of said permanent traffic signal system.

5. The system of claim 1 wherein said portable system controller is configured to override at least partially said predetermined timing sequence by responding to external instruction signals which determine a function, timing, or other characteristics of said sequence of operation of said portable electrically operated signals.

6. The system of claim 1 wherein said portable power supply comprises at least one of a cell or battery of cells and a solar panel or other charging source.

7. A temporary traffic signal system for controlling traffic, comprising:

electrically operated signals to be displayed for controlling said traffic, said electrically operated signals being configured to be portable for use at a selectable location;

at least one switch to operate said electrically operated signals;

a portable system controller operable for controlling said at least one switch;

one or more timing mechanisms for generating a predetermined timing sequence for use by said portable system controller to control a sequence of operation of said electrically operated signals to be displayed; and a receiver for receiving external control data when said external control data is present, said portable system controller being configured to respond to a receipt of said external control data in at least one of a first mode of operation wherein said portable system controller inhibits its operation of said electrically operated signals and a second mode of operation wherein said portable system controller whereupon said controller utilizes said external control data to determine at least partially said sequence of operation of said electrically operated signals to be displayed, and wherein when said external control data is absent then said portable system controller is configured to utilize said predetermined timing sequence generated by said one or more timing mechanisms for controlling said electrically operated signals.

8. The system of claim 7 wherein when said external control data is absent then said portable system controller is operable to override at least partially said predetermined timing sequence by responding to external sensors that indicate the presence and/or location of vehicles and said predetermined timing sequence.

9. The system of claim 7 wherein when said external control data is absent then said portable system controller is operable to override at least partially said predetermined timing sequence by responding to external pre-emptive signals which indicate the approach of one or more emergency vehicles, with said portable system controller responding according to a predetermined instruction set.

10. The system of claim 7 wherein when said external control data is absent then said portable system controller is operable to override at least partially said predetermined timing sequence by responding to external instruction signals which determine the function, timing, or other characteristics of said portable system controller.

11. The system of claim 7 further comprising a permanent traffic signal system interface operable for producing said external control data.

12. The system of claim 7 further comprising at least one light sensor operable to detect a presence or absence of light, said at least one light sensor producing an output that is utilized to generate said external control data.

13. The system of claim 12 further comprising said at least one light sensor comprising a mounting suitable for temporary attachment adjacent to at least one light of a permanent traffic signal system.

14. A method to provide backup traffic signals for controlling traffic that is suitable for temporarily replacing a permanent traffic signal system that is subject to outages, said method comprising:

providing portable electrically operated traffic signals suitable to be displayed at a selectable location for controlling said traffic;

generating a predetermined timing sequence to control a sequence of operation of said portable electrically operated traffic signals;

providing at least one receiver for receiving external control data when said external control data is available; wherein the external control data is generated in accordance to sensed operation and outage of permanent traffic signals;

controlling said portable electrically operated signals utilizing said predetermined timing sequence when said external control data is not available; and controlling said portable electrically operating signals responsive to receipt of said external control data when said external control data exists for coordinating operation of portable electrically operated by operating in at least one of a first mode of operation and a second mode of operation such that in said first mode of operation said permanent traffic signal system is utilized substantially exclusively for controlling a direction of flow of said traffic, and in said second mode of operation said external control data is utilized to provide synchronization between said portable electrically operating signals and said permanent traffic signal system.

15. The method of claim 14, further comprising providing a selector for selecting between said first mode of operation and said second mode of operation.

16. The method of claim 14 wherein said step of receiving further comprises receiving said external control data from said permanent traffic signal system whenever said permanent traffic signal system is operational.

17. The method of claim 16 wherein intermittent operation of said permanent traffic signal system results in a synchronization of said portable electrically operating signals with signals of said permanent traffic signal system whenever said permanent traffic signal system is operation.

18. The method of claim 16 wherein said external control data is wirelessly transmitted.

19. The method of claim 16 wherein optical sensors detect operation of said permanent traffic signal system.

* * * * *